United States Patent [19]

Phillips

[11] Patent Number: 4,747,469

[45] Date of Patent: May 31, 1988

[54] COLLAPSIBLE SAWHORSE ARRANGEMENT

[76] Inventor: Theodore D. Phillips, 706 S. Kenmore Dr., Evansville, Ind. 47715

[21] Appl. No.: 9,675

[22] Filed: Feb. 2, 1987

[51] Int. Cl.[4] ..... B27B 21/00

[52] U.S. Cl. ..... 182/185; 182/46; 182/224

[58] Field of Search ..... 182/46, 181–186, 182/224–226

[56] References Cited

U.S. PATENT DOCUMENTS 2,812,219 11/1957 Lange ..... 182/185
3,456,100 7/1969 Green ..... 182/46
4,014,405 3/1977 Breisch ..... 182/46
4,124,093 11/1978 Breisch ..... 182/46

*Primary Examiner*—Reinaldo P. Machado
*Attorney, Agent, or Firm*—Warren D. Flackbert

[57] ABSTRACT

A collapsible sawhorse arrangement characterized by a generally horizontal work receiving member including a lower plate portion and a vertical plate portion extending longitudinally therealong. The lower plate portion presents pairs of openings on opposite sides of the vertical plate portion adapted to receive supporting legs for the work receiving member, such supporting legs angling inwardly in a bearing relationship with the walls of the vertical plate portion. In a preferred embodiment, enlargements are presented on the walls of the vertical plate portion which serve frictional engagement purposes with the supporting legs.

4 Claims, 1 Drawing Sheet

COLLAPSIBLE SAWHORSE ARRANGEMENT

As is known, the use of sawhorses at building sites, for home improvement jobs, or wherever, is widespread. Most of the sawhorses presently in use, however, include unitary supporting legs, such requiring sufficient and, oftentimes, otherwise usable space for transporting and/or storage. A need has arisen, therefore, for a sawhorse which is totally collapsible in form, serving convenience to the user, and, at the same time, durable upon erection at the use site.

The invention accomplishes the latter by presenting sawhorse legs, defined by hollow tubing, selectively insertable into and maintained at an operative position along the length of the main work receiving member or spine, where the latter is of any preselected length. In any event, the preceding components are readily assembled, and, typically, made from a high density plastic resin, presenting optimum physical characteristics in use, in transporting and in storage. In this connection, rigidity, sturdiness, and compactness are noteworthy features.

In any event, a better understanding of the present invention will become more apparent from the following description, taken in conjunction with the accompanying drawing, wherein FIG. 1 is a view in side elevation of a collapsible sawhorse arrangement assembled in accordance with the teachings of the present invention;

Figure 1:
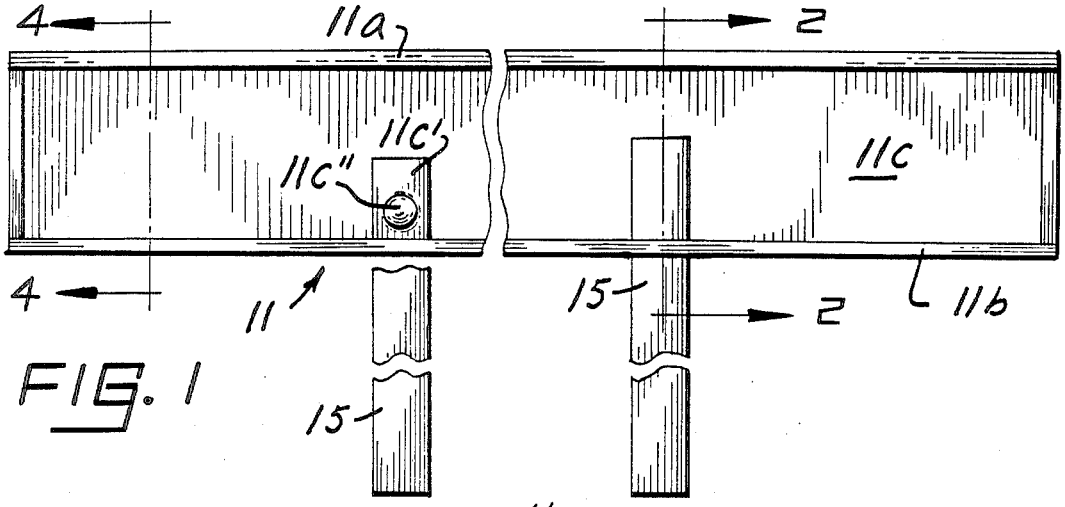

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
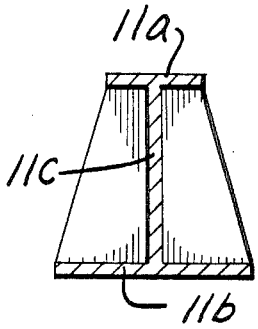
Figure 3:
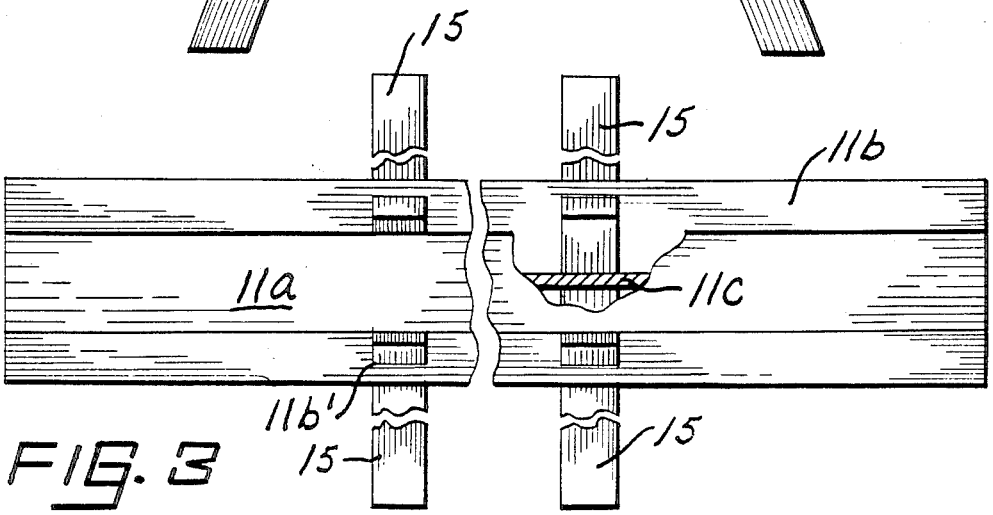
FIG. 3 is a top plan view, partly fragmentary, and generally comparing to FIG. 1, showing further assembly details; and, FIG. 4 is a view in vertical section, taken at line 4—4 on FIG. 1 and looking in the direction of the arrows, further detailing the main work receiving member of the collapsible sawhorse arrangement presented herein.

Referring now to the figures, and first to FIGS. 1 and 4, the work receiving member or spine 11 of the instant collapsible sawhorse arrangement is generally in the form of a horizontally extending modified I-beam, the latter defined by an upper plate portion 11*a*, a lower plate portion 11*b* and a vertical interconnecting plate portion 11*c*, all integrally arranged (see FIG. 4). The work receiving member 11 may be of any preselected length, depending upon a user's requirements and, of course, transporting and/or storage factors.

Figure 2:
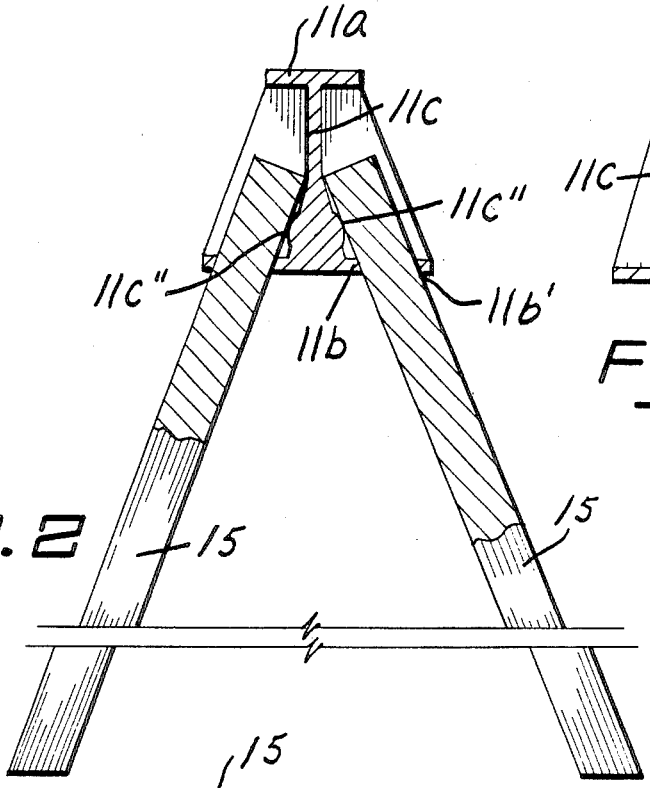
FIG. 2 is a view in vertical section, taken at line 2—2 on FIG. 1 and looking in the direction of the arrows, detailing the instant sawhorse arrangement.

The vertical interconnecting plate portion 11*c* includes a series of spaced apart webs 11*c'* having pressure areas or buttons 11*c''* along the length thereof, the reasons for which will become more apparent from the following discussion. Additionally, and importantly, the bottom surface of lower plate portion 11*b* includes openings or cut-outs 11*b'*, in opposing pairs on either side of the vertical plate portion 11*c*, such serving to receive legs 15 which support the work receiving member or spine 11 (see FIG. 2).

In other words, and in the practice of the invention, legs 15 are maintained along the length of the work receiving member or spine 11 by insertion through the appropriate cut-outs 11*b'* and into engagement with the walls of the vertical interconnecting plate portion 11*c*. Moreover, and in order to more solidly retain legs 15 in an operative position, the pressure areas 11*c''* on the webs 11*c'* serve frictional engagement purposes. In any event, positive leg 15 positioning, i.e. placement (and/or removal), is readily accomplished, where work receiving member or spine 11 is then readied for a work condition.

The components defining the instant collapsible sawhorse are, typically, made from a high density plastic resin, such as that marketed under the NOREL label. In other words, with such material choice, the finished collapsible unit is more durable than wood; readily carried to a use site; and, representative of overall ease in erection and disassembly.

The collapsible sawhorse arrangement described hereabove is, of course, susceptible to various changes within the scope of the invention, including, by way of example, in proportioning; the top edge of the plate portion 11*c* could serve work receiving purposes instead of the upper plate portion 11*a*; material selection; the number of pairs of legs involved; the precise manner of leg assembly; and, the like. Thus, the preceding should be considered illustrative and not as limiting the scope of the following claims.

I claim:

1. A collapsible sawhorse arrangement comprising a generally horizontal work receiving member having a first plate portion and a second plate portion at a normal relationship therewith and extending from either side thereof, pairs of openings disposed in said second plate member along said work receiving member, and supporting legs for said work receiving member extending through said openings and bearing against opposite walls of said first plate portion, where said opposite walls of said first plate portion include enlargements in frictional engagement with said supporting legs.

2. The collapsible sawhorse arrangement of claim 1 where said enlargements are disposed on webs extending between said opposite walls of said first plate portion and said second plate portion.

3. The collapsible sawhorse arrangement of claim 1 where a third plate portion extends laterally from the top of said first plate portion in a work receiving relationship.

4. The collapsible sawhorse arrangement of claim 3 where said third plate portion is narrower than said second plate portion.

* * * * *